US006684920B2

(12) United States Patent
Seitz et al.

(10) Patent No.: US 6,684,920 B2
(45) Date of Patent: Feb. 3, 2004

(54) BEVERAGE DISPENSER AND AUTOMATIC SHUT-OFF VALVE

(75) Inventors: Forrest S. Seitz, Beaverton, OR (US); Philip M. Krebs, West Linn, OR (US); Brian J. Darby, Portland, OR (US); Denise K. Myers, Washougal, WA (US); John D. Cochran, Lake Oswego, OR (US)

(73) Assignee: Manitowoc Foodservice Companies, Inc., Manitowoc, WI (US)

( * ) Notice: Subject to any disclaimer, the term of this patent is extended or adjusted under 35 U.S.C. 154(b) by 0 days.

(21) Appl. No.: 10/259,541

(22) Filed: Sep. 27, 2002

(65) Prior Publication Data

US 2003/0084957 A1 May 8, 2003

Related U.S. Application Data

(60) Provisional application No. 60/325,871, filed on Sep. 28, 2001.

(51) Int. Cl.[7] ..... B65B 3/26

(52) U.S. Cl. ..... 141/198; 141/95

(58) Field of Search ..... 141/95, 100, 105, 141/198, 206, 267, 283, 351, 360

(56) References Cited

U.S. PATENT DOCUMENTS

| | | | |
|---|---|---|---|
| 585,264 | A | 6/1897 | Fahrney |
| 2,639,078 | A | 5/1953 | Karlen |
| 3,269,606 | A | 8/1966 | Armstrong |
| 3,520,638 | A | 7/1970 | McUmber et al. |
| 3,616,824 | A | 11/1971 | Orlando |
| 3,670,765 | A | 6/1972 | Haynes |
| 3,839,645 | A | 10/1974 | Nickerson |
| 3,916,961 | A | 11/1975 | Dilger |
| 3,916,963 | A | 11/1975 | McIntosh |
| 4,202,387 | A | 5/1980 | Upton |
| 4,216,885 | A | 8/1980 | Sedam |
| 4,236,553 | A | 12/1980 | Reichenberger |
| 4,376,496 | A | 3/1983 | Sedam et al. |
| 4,408,640 | A | 10/1983 | Voza |
| 4,426,019 | A | 1/1984 | Sedam |
| 4,437,499 | A | 3/1984 | Devale |
| 4,440,200 | A | 4/1984 | DeVale et al. |
| 4,458,735 | A | 7/1984 | Houman |
| 4,493,441 | A | 1/1985 | Sedam et al. |
| 4,559,979 | A | 12/1985 | Koblasz et al. |
| 4,641,692 | A | 2/1987 | Bennett |
| 4,712,591 | A | 12/1987 | McCann et al. |
| 4,738,285 | A | 4/1988 | Belland |
| 4,753,277 | A | 6/1988 | Holcomb et al. |
| 4,780,861 | A | 10/1988 | Stembridge et al. |

(List continued on next page.)

FOREIGN PATENT DOCUMENTS

| | | |
|---|---|---|
| EP | 0 075 492 A1 | 3/1983 |
| GB | 2 099 791 A | 12/1982 |

OTHER PUBLICATIONS

Search Report for corresponding international application, PCT/US02/30975, dated Feb. 3, 2003.

*Primary Examiner*—Gregory L. Huson
*Assistant Examiner*—Peter deVore
(74) *Attorney, Agent, or Firm*—Brink Hofer Gilson & Lione

(57) ABSTRACT

A beverage mixing and dispensing valve, or a beverage dispenser including the valve, includes an automatic shut-off features. A user presses a cup or container against a lever on a soft-drink dispenser. The lever closes a switch to activate the opening of a solenoid-operated valve. At the same time, a detection circuit is monitored to determine whether overflow of drink or foam has occurred. When drink or foam overflows and bridges a gap between two metal conductors on the lever, resistance is lowered and electricity flows in the detection circuit. The valve then automatically shuts off the flow of beverage. Energy is saved in keeping the valve open using a pulse width modulation (PWM) technique for voltage to the solenoid, rather than using a steady-state voltage.

53 Claims, 8 Drawing Sheets

U.S. PATENT DOCUMENTS

| | | | | |
|---|---|---|---|---|
| 4,890,774 | A | | 1/1990 | Poore |
| 4,895,194 | A | | 1/1990 | McCann et al. |
| 4,944,332 | A | | 7/1990 | Belland |
| 4,953,751 | A | | 9/1990 | Shannon |
| RE33,435 | E | | 11/1990 | Koblasz et al. |
| 4,972,883 | A | | 11/1990 | Hassell et al. |
| 4,974,643 | A | | 12/1990 | Bennett et al. |
| 5,129,548 | A | | 7/1992 | Wisniewski |
| 5,186,363 | A | | 2/1993 | Haynes |
| 5,228,486 | A | | 7/1993 | Henninger |
| RE34,337 | E | | 8/1993 | Bennett |
| 5,454,406 | A | | 10/1995 | Rejret et al. |
| 5,476,193 | A | | 12/1995 | Haynes |
| 5,491,333 | A | | 2/1996 | Skell et al. |
| 5,732,563 | A | | 3/1998 | Bethuy et al. |
| RE35,780 | E | | 5/1998 | Hassell et al. |
| 5,797,519 | A | | 8/1998 | Schroeder et al. |
| 6,041,970 | A | | 3/2000 | Vogel |
| 6,056,000 | A | | 5/2000 | Santacatterina et al. |
| 6,058,986 | A | * | 5/2000 | Bethuy et al. ..... 141/198 |
| 6,061,224 | A | | 5/2000 | Allen |
| 6,067,490 | A | | 5/2000 | Ichimaru et al. |
| 6,199,002 | B1 | | 3/2001 | Otaki et al. |

* cited by examiner-

FIG.2
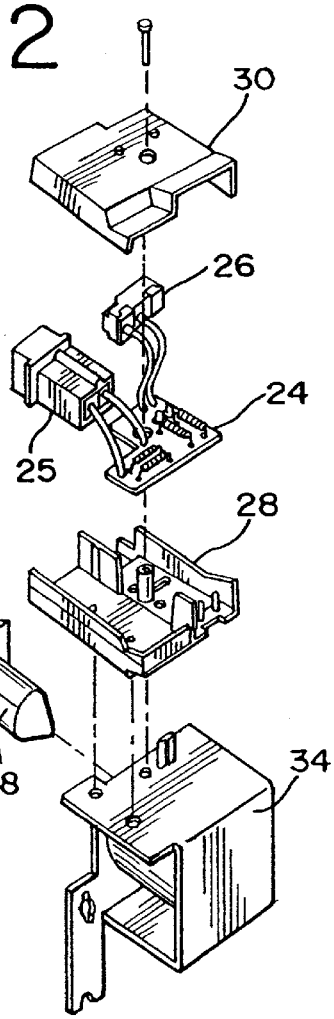
FIG.3
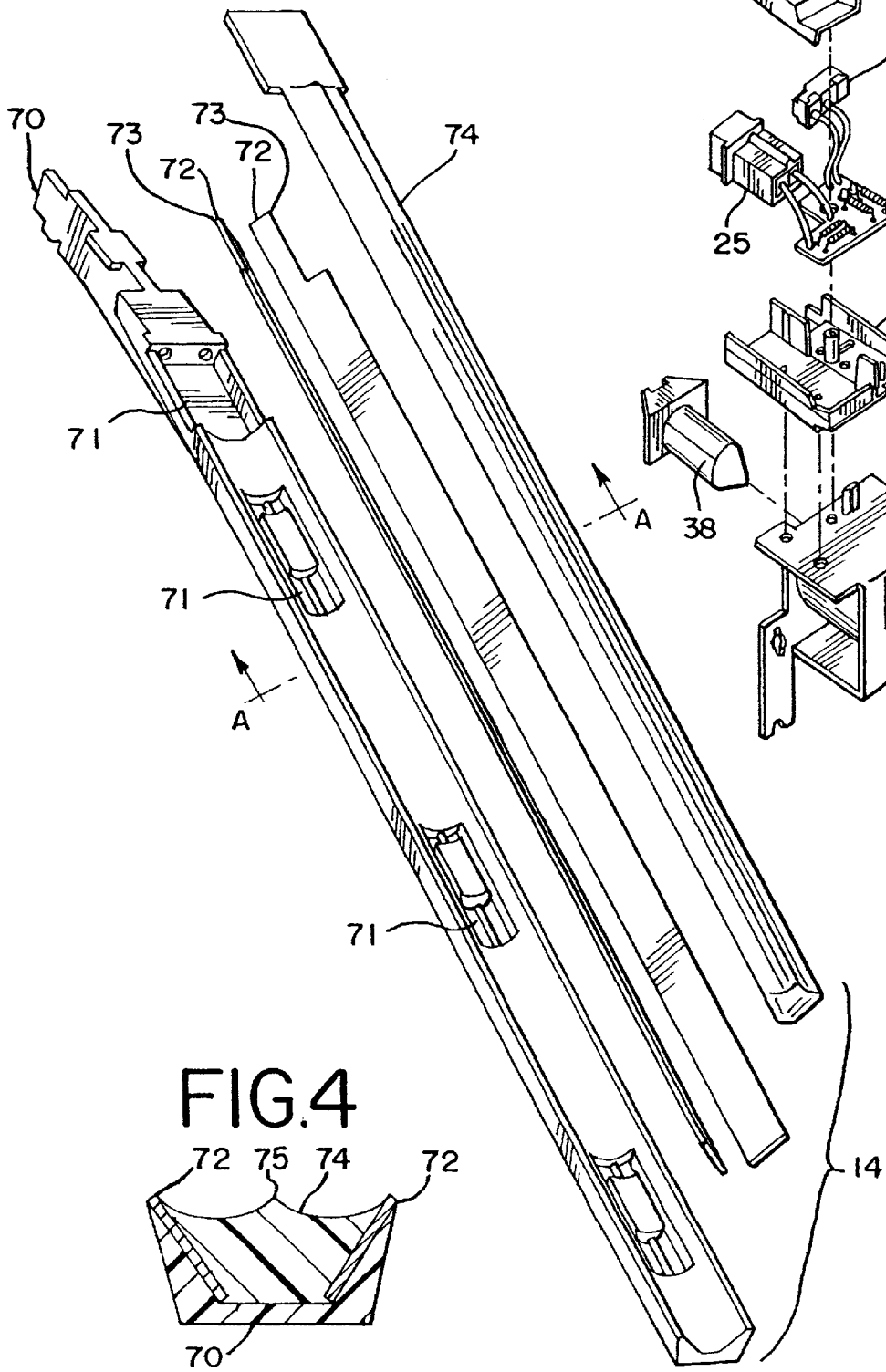
FIG.4

BEVERAGE DISPENSER AND AUTOMATIC SHUT-OFF VALVE

This application claims the benefit of the filing date under 35 U.S.C. § 119(e) of Provisional U.S. Patent Application Serial No. 60/325,871, filed on Sep. 28, 2001, which is hereby incorporated by reference in its entirety.

FIELD OF THE INVENTION

This invention concerns beverage dispensers and a method for using beverage dispensers. In particular, the field of the invention relates to an automatic shut off valve for a dispenser and a method of using the dispenser to minimize energy usage and heating of the dispensed beverage.

BACKGROUND OF THE INVENTION

Fast service restaurants need equipment that makes their employees as efficient as possible. Every task in food preparation and service has long been analyzed, and restaurant kitchens and food preparation areas are now designed and laid out with efficiency and total-cost-of-ownership in mind. One very important area in food service is the beverage dispensing function. It is an area that is relatively well disposed to mechanization and automation, since there are standard sizes (small, medium, large, and some variation of super-size or extra large) for most beverages. There is certainly a need to minimize the time an employee spends waiting for a soft-drink dispenser to fill up a cup. Therefore, some soft-drink dispensers now have solenoid-operated valves that can automatically shut off. Other restaurants have resorted to self-service, with the customers themselves dispensing the drinks, freeing employees from this task, but losing control over the machine in the process.

Prior art patents, such as U.S. Pat. Nos. 4,712,591 and 4,753,277, disclose beverage dispensing machines with automatic shut-offs that utilize an electrical circuit that passes through the beverage. That is, one electrode from a controller is placed in the soft-drink stream, usually at or near the nozzle. When foam or beverage overflows the cup, the beverage makes contact with another electrode, completing an electrical path through the beverage and to the machine. This other electrode typically forms part of the lever a user presses to dispense a drink. A microprocessor detects the completed circuit and shuts the solenoid controlling the valve. These beverage dispensers suffer from a number of defects. One principal defect is that the current passes through the drink itself, flowing from the nozzle, through the drink to another electrode. Another disadvantage is that present valves and beverage dispensers must be designed and built to accommodate an electrical conductor in the nozzle that extends down to a container that will be filled with the beverage.

Other dispensers, such as those described in U.S. Pat. No. 3,916,963, depend on immersing an electrode or electrodes in the cup or container into which the beverage is dispensed. One defect of this design is that electrodes have to be placed in the cup. This can lead to unsanitary conditions, and could also undesirably mix an unwanted flavor into the drink being dispensed. These electrodes also add another component to the beverage mixing and dispensing valve. What is needed is a soft-drink dispenser having an automatic shut-off that does not have an electrical circuit that passes through the beverage or electrical conductors in the nozzle.

SUMMARY

In order to address these deficiencies of the prior art, an automatic valve for a beverage dispenser has been invented.

One aspect of the invention is an automatic shut-off valve for dispensing a beverage into a container. The automatic shut-off valve comprises at least one electrically-operated valve, a detection circuit comprising at least two spaced conductors, the detection circuit wholly external to the container and capable of detecting conductivity between the at least two spaced conductors, and a controller that shuts off the at least one electrically-operated valve automatically when liquid or foam from a beverage creates a conductive path between the at least two spaced conductors.

Another aspect of the present invention is a method of dispensing a beverage with an automatic shut-off valve. The method comprises providing a container having an open mouth, opening at least one electrically-operated valve to begin dispensing the beverage into the container, and detecting a change in an electrical detection circuit wholly external to the container while dispensing the beverage. The method also comprises automatically closing the electrically-operated valve upon detecting a change in the electrical detection circuit.

Another aspect of the invention is a method of dispensing a beverage into a container. The method comprises providing a container, opening at least one solenoid valve to fill the container with the beverage, and keeping the valve open by a pulse-width-modulation technique while operating a detection circuit wholly external to the container. The method also comprises closing the valve automatically upon detecting a change in the detection circuit.

Another aspect of the invention is a beverage dispenser for dispensing a beverage into a container. The beverage dispenser comprises at least one mixing and dispensing valve for dispensing a beverage, the at least one mixing and dispensing valve comprising at least one solenoid-operated valve for controlling a flow of at least one fluid, a detection circuit comprising at least two spaced conductors, the detection circuit wholly external to the container and capable of detecting conductivity between the at least two spaced conductors, and a controller that shuts off the at least one solenoid-operated valve automatically when beverage foam or liquid creates a conductive path between the at least two spaced conductors. The beverage dispenser also comprises a drip tray below the at least one mixing and dispensing valve and a housing for mounting the drip tray and the at least one mixing and dispensing valve.

The advantages of the beverage dispenser and the automatic shut-off valve used with the beverage dispenser include a simpler nozzle design that does not require an electrical conductor in the nozzle as a part of the detection circuit. The shut-off valve in the embodiments of the present invention has no detection electrode in the nozzle and does not make contact with the beverage in the container. The electrode thus does not mix undesired previous flavors into beverages which are dispensed afterwards. These and other aspects and advantages of the invention will be made clearer in the accompanying drawings and explanations of the preferred embodiments.

BRIEF DESCRIPTION OF THE FIGURES

FIG. 2 is an exploded view of a portion of the dispensing valve of FIG. 1B.

FIG. 3 is an exploded, perspective view of the parts of an actuating lever from the dispensing valve of FIG. 1B.

FIG. 4 is a cross-sectional view taken along line A—A of the lever of FIG. 3.

DETAILED DESCRIPTION OF THE PREFERRED EMBODIMENTS

The preferred automatic shut-off valve for dispensing a beverage may be thought of as having two principal portions, a detection circuit and a controller. The detection circuit includes at least two spaced conductors, the detection circuit wholly external to a container for receiving the beverage. The controller controls at least one power switching circuit and is connected to at least one electrically-operated solenoid valve. The user dispenses a beverage by activating the power switching circuit to open the at least one electrically-operated solenoid valve, and the controller automatically shuts the at least one electrically-operated solenoid valve upon detecting a change in the detection circuit. In a typical soft drink dispenser, there may be only one solenoid but two valves, one for syrup and one for water, carbonated or non-carbonated water. The valve may also include a microswitch tripped by an actuating lever or other switch, such as a touch-screen or push-button, to begin dispensing a soft drink. If a push-button or touch-screen are used to begin dispensing, then the lever functions only as a sensor in the electrical circuit mentioned below. The valve includes at least one power switching circuit for automatically opening or closing the at least one valve, and a detection circuit for detecting when the container is full. The controller is desirably a microprocessor controller.

Figure 1A:
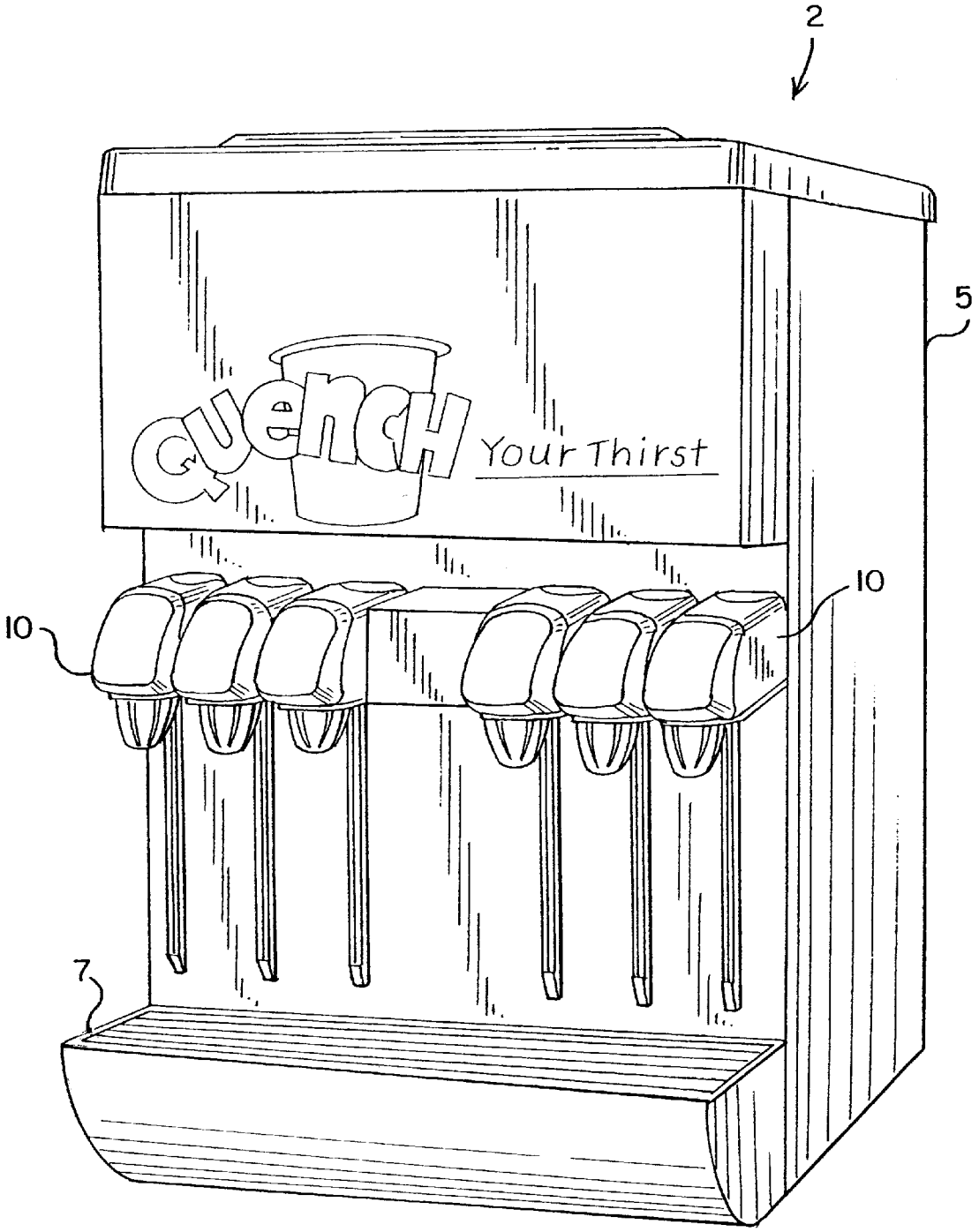
FIG. 1A is a perspective view of a beverage dispenser having automatic shut off beverage and dispensing valves of the present invention.
Figure 1B:
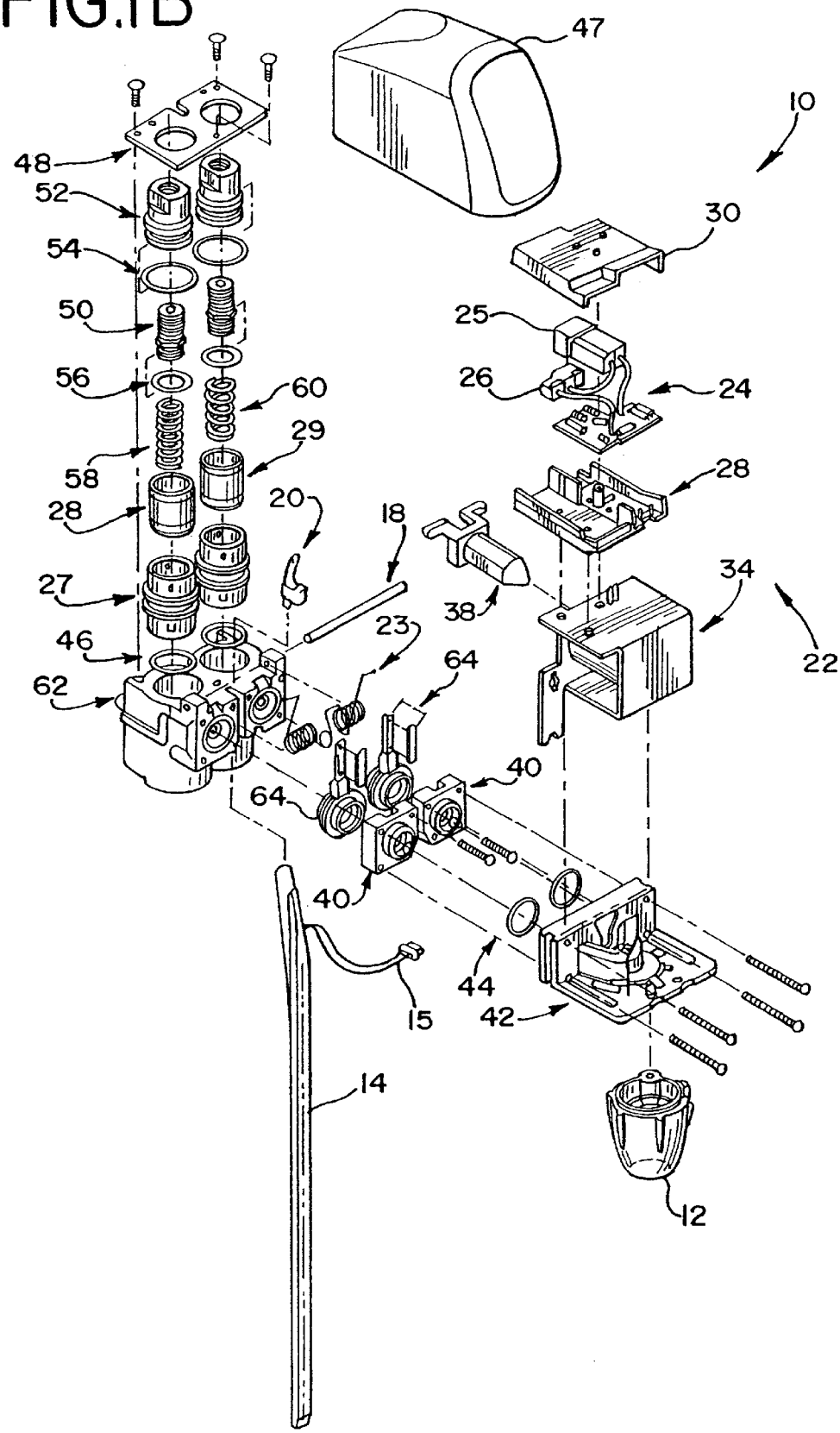
FIG. 1B is an exploded view of a preferred automatic shut-off beverage mixing and dispensing valve of the present invention.

FIG. 1A is a beverage dispenser 2 having a housing 5, a drip tray 7, and several beverage mixing and dispensing valves 10. FIG. 1B is an exploded view of a preferred embodiment of the beverage mixing and dispensing valve 10. In many respects, this valve is just like a conventional electrically-operated mixing and dispensing valve. However, the valve is modified to include both the automatic shutoff and power consumption features of the present invention. The solenoid 34 has a single plunger 38. When the solenoid 34 is actuated and the plunger 38 moves into the coil area, torsional springs 23 are put into torsion, opposing the opening of the valve pallets 64. Water and syrup flow in their respective channels through control base 62, valve pallets 64, orifice caps 40, and diffuser block 42, sealed with O-rings 44. The diffuser block 42 leads to nozzle 12. The upper portion of nozzle 12 may also function as a mixing chamber in which the streams are mixed thoroughly before leaving nozzle 12. Other embodiments may have a separate mixing chamber upstream of the nozzle.

The vertical stacks depicted in FIG. 1B, mounted in control base 62, are dynamic pressure compensating devices meant to stabilize flows of syrup and water. The devices include pistons 29 moving in matching cylinders 27 sealed by additional O-rings 46. Adjustment to the relative flow of water and syrup are made through Brix adjustments, using Brix screws 50 and nuts 52, sealed with additional O-rings 54 and 56. Springs 58 and 60 allow better control over the Brix adjustments. Retainer plate 48 retains the components of the dynamic pressure compensating devices within their mount, flow control base 62. Water and syrup flow through the valve flow control base 62, through the valve pallets 64 and orifice caps 40, diffuser block 42, and into and out of the nozzle 12.

The dispensing valve 10 has an actuating lever 14 with a connector 15. Actuating lever 14 mounts to a retainer cap 20, which pivots about a pivot pin 18. When a user presses on actuating lever 14 to dispense a drink, retainer cap 20 pivots about pivot pin 18 and strikes microswitch 26 on the control circuit board 24 of the dispenser. The microswitch then triggers a control sequence in which the solenoid valve opens and a soft drink is dispensed. Wires connected to conductors on lever 14 are connected through connector 15 to a mating connector 25 on control circuit board 24. Spaced conductors (described below) mounted on lever 14 also act as a sensor for a detection circuit, in which a resistance of the detection circuit may be read by a microprocessor on control circuit board 24 when the detection circuit is connected to the control board by means of the indicated connectors. The soft drink dispenser valve 10 also includes a housing cover 47 and internal circuit top and bottom covers 28, 30 for a circuit board 24, which mounts microswitch 26 and is connected to a connector 25.

FIG. 2 is a closer view of the control portion of this embodiment of the invention. The solenoid 34 includes its own housing and an internal coil (not shown). Plunger 38 is drawn into solenoid 34 electrically, or expelled by an internal spring (not shown). Included also are bottom housing 28 and top housing 30 for circuit board 24. Connected to the circuit board 24 are connector 25, microswitch 26, and a controller (not shown) for controlling the operation of the solenoid and the dispensing valve. A microprocessor controller is a preferred controller for the beverage dispensing valve. A number of other components may also be mounted on the circuit board, including, but not limited to, resistors, diodes, capacitors, switches and other electrical and electronic parts.

It is important to note that the detection circuit for shutting the beverage off automatically is wholly external to the container used to hold the beverage. The circuit includes conductors built into actuating lever 14, and only the liquid beverage or foam that overflows the cup contacts the conductors. Current or voltage flows only when there is liquid or foam contacting both conductors simultaneously, and the flow is only over the surface of the lever. The detection circuit does not include the cup or the beverage within the cup. The actual circuit used for detection may be a voltage circuit, a current circuit or a resistance circuit, or a combination of these and other electrical circuits. The contact of beverage foam or liquid with the conductors in the actuating lever changes a resistance, a current flow, or a voltage drop in the detection circuit. It is this change that is detected and used to shut off the valve automatically.

FIGS. 3 and 4 provide closer views of the actuating lever 14 of the dispensing valve. The lever is preferably a composite of several materials, including conductors 72 and insulative portions 70 and 74. Conductors 72 are preferably stainless steel (for food contact) whose surfaces have been activated for bonding with the insulative portions. One method of activating the surface is to roughen the surface by applying an 80-grit abrasive to the surfaces of the steel.

Other methods may be used to roughen the surface. In a preferred method of manufacturing the lever, first insulative portion 70 is injection molded. Then, first insulative portion 70 is placed into another injection molding tool with stainless steel conductors 72 having a roughened surface. A second molding operation produces the lever 14 by molding second insulative portion 74 onto components 70 and 72. As noted in FIG. 3, first molded portion 70 is configured for mating and assembly to the retainer lever cap 20. The voids 71 in insulative portion 70 are useful when overmolding with insulative portion 74 to insure good bonding between first and second portions 70, 74, and to insure capture, bonding and constant spacing of conductors 72 within the lever. While this embodiment uses two conductors 72, more than two may also be used, such as 3 or 4 spaced conductors. While this embodiment uses lateral spacing, vertical spacing within the lever may also be used, wherein the beverage or foam must travel a small distance downward to make electrical contact between two conductors. Wires 73 for connecting to connector 15 may be joined to conductors 72 when desired.

The insulative material used for the lever insulative portions 70, 74 is desirably non-conductive and highly insulative, and must also have sufficient flexural modulus and tensile strength for repeated usage, such as in fast-service or self-service restaurants. Thermoplastics are preferred, since they may be injection molded, but other insulators and thermoset materials may also be used, as for instance, by compression molding. One injection molding material that has been found suitable for this application is Makroblend® UT408 polymer from Bayer Corporation, Pittsburgh, Pa. This polymer is a blend of polycarbonate and polyethylene terephthlate (PET) polyester. The polymer has a room-temperature flexural modulus of about 340 ksi, and a tensile strength of about 8 ksi. It has a strain-to-break ratio of about 120%, a strain-to-yield ratio of about 5%, and a room temperature Izod strength of about 2 ft-lb/in. These properties may be important if the lever, subjected to repeated use, is to last for a long time before replacement. Other polymers with similar properties may also be used.

FIG. 4 provides a cross-sectional view of the lever 14 taken along line AA. The maximum width is about 12 mm and the thickness is about 5 mm. The lever has a profile as shown, having first insulative portion 70 and a second insulative portion 74 apportioned into left and right portions, separated by a crown or peak 75. The peak and the outer edges of the conductors 72 are at about the same height, with the middle portions being about 1 mm lower. When a cup of a user approaches its capacity, liquid or foam from the beverage will spill over a rim of the cup and splash onto the top surface of the lever, contacting insulative portion 74 and creating a conductive path between conductors 72. However, the peaked surface 75 causes the beverage foam or liquid to condense and rapidly dissipate or drain away, thereby breaking conductivity between conductors 72.

The microprocessor controller of the solenoid checks the detector circuit at about a 50–100 Hz rate, or about every 10 to 20 milliseconds. Other sampling rates may be used as desired and convenient. If beverage foam or liquid is present, there will be a change in the electrical detector circuit. The solenoid then closes and water does not flow. However, it is important that the beverage dispenser allows a user to "top-off" the drink when the beverage liquid or foam dissipates. Because the conductivity cannot be sustained due to peaked surface 75, as soon as the beverage liquid or foam dissipates, the detection circuit quickly returns to its normal nonconducting state. When there is no continuity between the conductors of the actuating lever, the microprocessor controller can begin a top-off cycle, and the beverage dispenser dispenses water until the beverage overflows again, changing the state of the detector circuit. At this point, the drink has been topped off, and the beverage dispenser is ready for the next drink or the next customer. If the beverage is one that does not require a top-off, such as lemonade, the microprocessor may end the cycle, shutting off voltage to, and closing, the solenoid.

The lever molded with metallic conductors and pivotally mounted to activate a microswitch is an easy, convenient tool for starting the flow of beverage. However, even with the conductive lever available, the dispenser may be started by other tools or methods. For instance, a manufacturer may design in a "start" push-button or a small touch-screen menu for users to select "start." All these may be linked in a mechanical or electrical/electronic way to start dispensing a beverage. In these cases, the mechanical lever may be replaced by a sensor rod having the same makeup and the same conductors separated by the same nonconductive plastic material.

Figure 6:
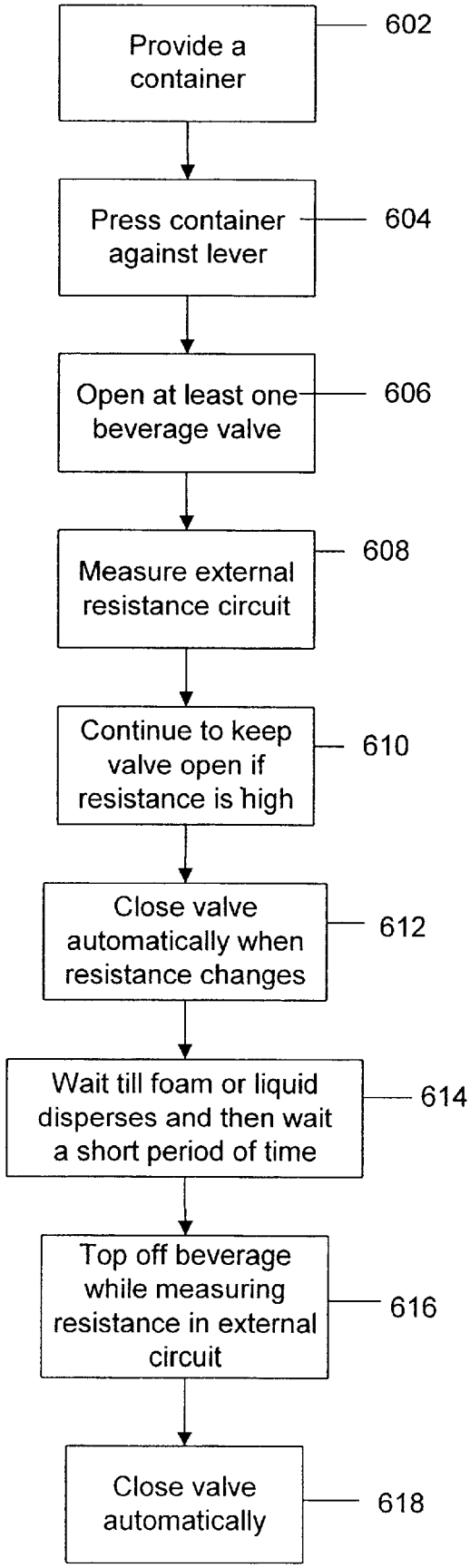
FIG. 6 is a flow chart for a preferred method of dispensing a beverage according to the present invention.

FIG. 6 depicts a method of dispensing a beverage. In this method, a user provides a container 602 for the beverage. The user then presses the container, such as a beverage cup, against the dispensing lever 604. This causes the dispenser to open at least one beverage valve, such as solenoid valve 606. At this point, the detection circuit is checked. So long as there is no change, the valve stays open and beverage flows 610. The valve will close automatically 612 upon a change in the resistance, voltage or current in the detection circuit, or when a prescribed time limit for beverage flow is exceeded. In one embodiment, a top-off mode may be used. In this case, detector checks may automatically ensue 614, until the beverage foam or liquid has dispersed and the resistance again goes high. A short waiting period ensues, preferably about 3 sec. Then the dispenser tops off the beverage while checking the detection circuit 616. When the detector indicates a change, or when a time limit has been exceeded, the valve closes automatically 618 and the sequence is ended.

Figure 5:
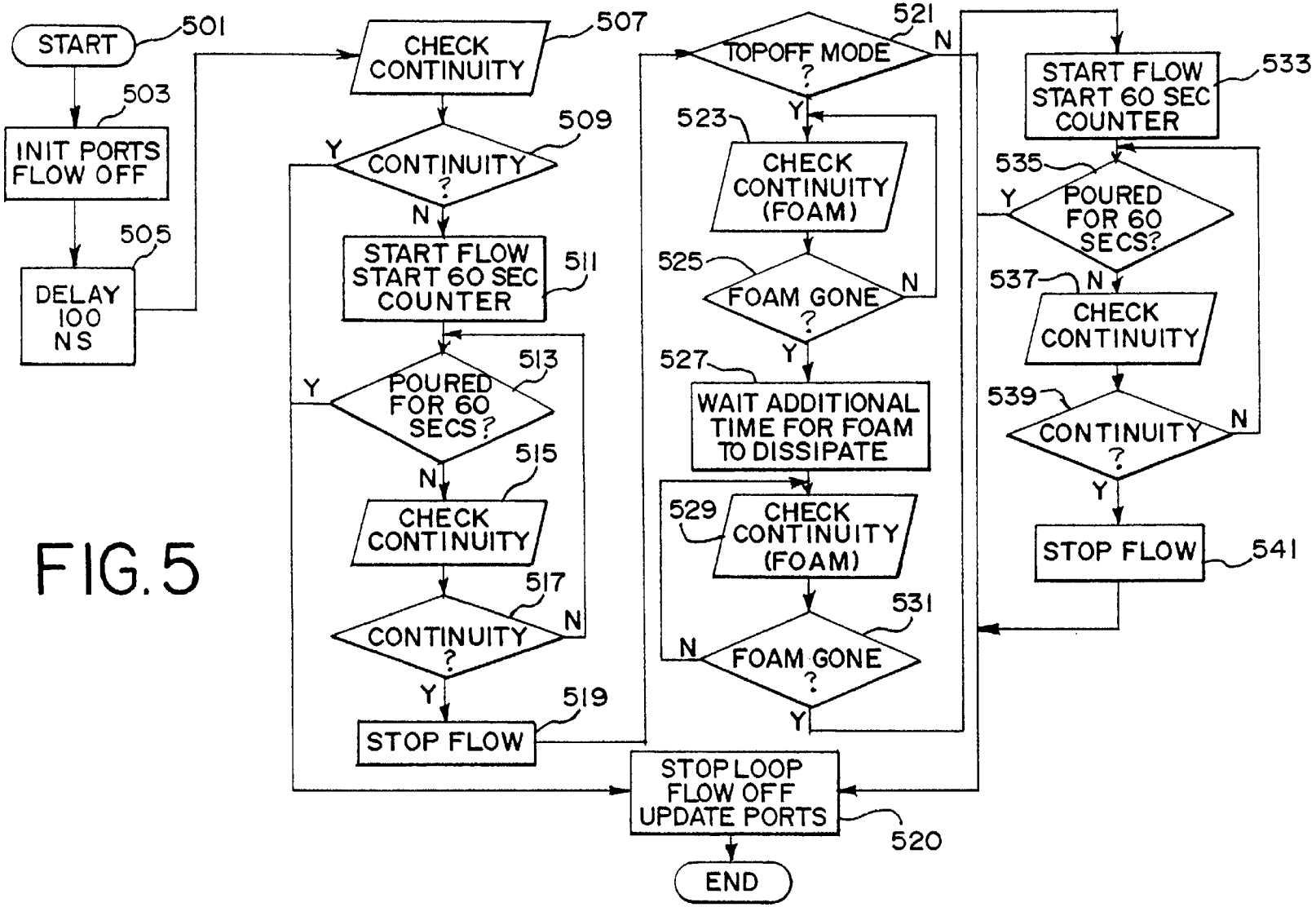
FIG. 5 is a flow chart for a routine run on the microprocessor of the dispensing valve of FIG. 1B.

FIG. 5 depicts a microprocessor routine that may be used in methods of dispensing a beverage according to embodiments of the present invention, as shown in FIG. 6, and using the beverage dispenser described above. A user starts the sequence 501 by pushing a cup or container against the dispensing lever. At this point 503, the microprocessor controller initializes the sequence with the valves closed and the flow off. An initial delay 505 of about 100 ms follows. The microprocessor then checks the detection circuit 507, searching for a signal that would indicate beverage foam or liquid on the actuating lever. At this point, the valves have not opened, so if continuity between the conductors is found 509, something is wrong and the sequence ends 520. Perhaps the lever should be cleaned, or there may be some other problem.

Assuming that the circuit is in order, the sequence proceeds with starting flow of beverage 511 and initiating a timer sequence as a back up to the detection circuit. As discussed above, the most common beverage may be one in which there are flows of both syrup and carbonated or non-carbonated water, requiring two valves. Other beverages dispensed may include single-component beverages, such as lemonade and beer, requiring only one valve. In one embodiment, 60 seconds is used as a timer maximum to shut off the valve if the detection circuit does not function properly. Other embodiments may use other maxima. The timer is checked periodically 513 through the process, as is the detection circuit 515. If a change is found 517, the flow of beverage is stopped 519 by a process that will be described below. The detection circuit may be checked as often as desired, with the goal of shutting off the flow of beverage as soon as possible after overflow of beverage foam or liquid. Checking the detection circuit at a frequency of 100 Hz has been used successfully, although other rates may also be used.

If the valve is not in "top-off" mode, then the process has been completed and the flow is stopped 520. If the valve is in top-off mode, the process continues with at least one additional check for detecting change 523 to determine whether foam or liquid has dissipated 525. A short period of time, from about 0.10 seconds to about 5 seconds, preferably about 3 seconds, may be programmed into the cycle to wait for the foam in the cup to dissipate 527 while automatically continuing to check the detection circuit for continuity. Then an additional check may be conducted 529, insuring that the foam contacting the conductor has dissipated 531. When the circuit no longer shows contact between the conductors 531, the program may begin a "top-off" mode 533, opening the at least one valve for the beverage and beginning a timing sequence. In one embodiment, the time period may be the same as for the fill sequence above; in other embodiments, the timer may be set for a shorter period of time, from about 1 second to about 15 seconds maximum.

The microprocessor controller periodically checks the time 535 and the detection circuit 537 to see whether either condition has been met. If the time has exceeded the maximum period allowed, the "top-off" cycle is over and the sequence is stopped 520 by the back up timer. Otherwise, the microprocessor continues to check the detection circuit 539 until a change occurs when the beverage checks or foam overflows. At that point, flow is stopped 541 and the sequence is ended 520. When the sequence ends 520, the microprocessor controller may update a count of the number of beverages dispensed, the size dispensed, the time required, and so forth. One microcontroller that has been found suitable for this application is an 8-pin, 8-bit CMOS microcontroller from Microchip Technology, Inc., for Mountain View, Calif. Model PIC12C508-04/SM has worked well in the application.

Another advantage of the preferred beverage mixing and dispensing valve 10 to use a pulse-width modulation (PWM) technique in keeping the solenoid open so that beverage can flow while power consumption is minimized. While this feature is part of a preferred valve with automatic shut-off, it may be used on any solenoidoperated beverage dispensing valve. A solenoid typically has an armature and a spring opposing the armature, so that when the solenoid is off, the spring keeps one or more valves closed. When a user wishes to open the valve(s), the user activates the armature and continues to flow current in a coil to keep the spring compressed. When current flows in a coil, it incurs I-squared-R losses, which are given off as heat. In a beverage dispensing valve, with all components packed into a relatively small package, the heat dissipates in two ways: convective heat transfer to the air and conductive heat transfer to the surrounding parts and especially to the coldest part, the beverage being dispensed. A PWM technique uses less energy and will ultimately result in a better and colder beverage for the consumer.

Figure 7A:
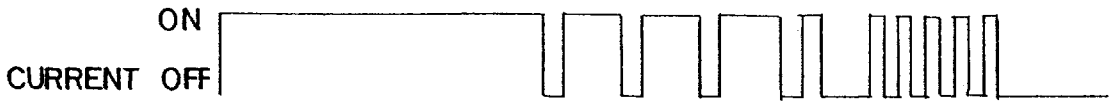
FIGS. 7A, 7B, and 7C are graphical representations of power consumption and machine performance for the valve of FIG. 1B.
Figure 7B:
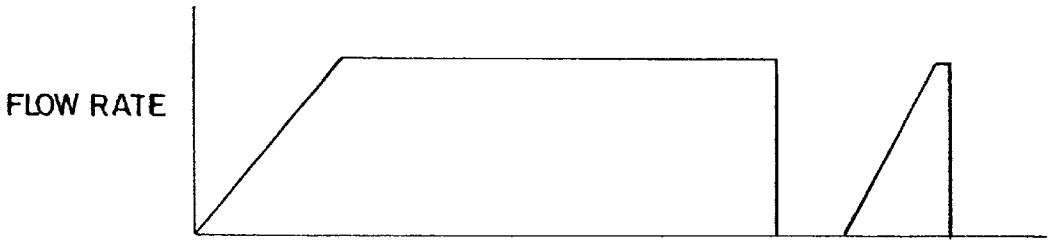
Figure 7C:
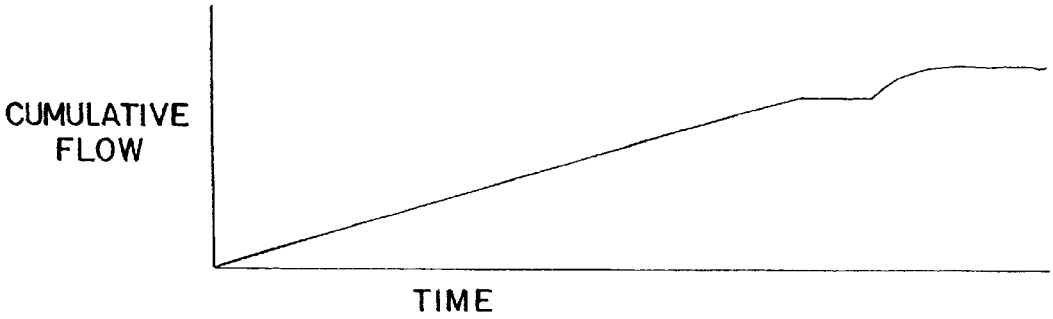

FIGS. 7A, 7B and 7C depict power consumption and beverage dispensing characteristics in a PWM technique as applied to a beverage dispenser. FIG. 7A depicts the flow of current to the coil of a solenoid over time. At start-up, a period of time is required to overcome the resistance of the restraining spring and the inertia of the plunger itself and its mechanical linkage to the valve or valves that allow beverage to flow. After a period of time, such as about 1 second to 15 seconds depending on cup size, a PWM technique is used, with power to the coil turned on and off periodically. In one embodiment, the power is pulsed from about 20 to about 30 Hz, with a duty cycle of about 75%. One cycle that has been found to work well is for power to be turned on for about 24 milliseconds and then off for 8 milliseconds. As shown in FIG. 7A, the PWM rate may be different for the "top-off" cycle, or it may be the same as for the normal "cup fill" cycle.

Because the power is cycled, there is less power and energy to dissipate and heat up the surroundings of the valve. However, the cycle used is also sufficient to keep the beverage valve or valves open and dispensing beverage. FIG. 7B depicts the flow of beverage over time, wherein the beverage at first flows slowly as the valve first opens, but then continues at a relatively constant rate as the PWM technique keeps the valve open sufficiently for beverage to flow. FIG. 7C depicts the cumulative flow of beverage into a container. The right-hand portion of the flow may be a short interruption when the "top-off" portion of the cycle begins, followed by the final filling of the container.

Figure 8:
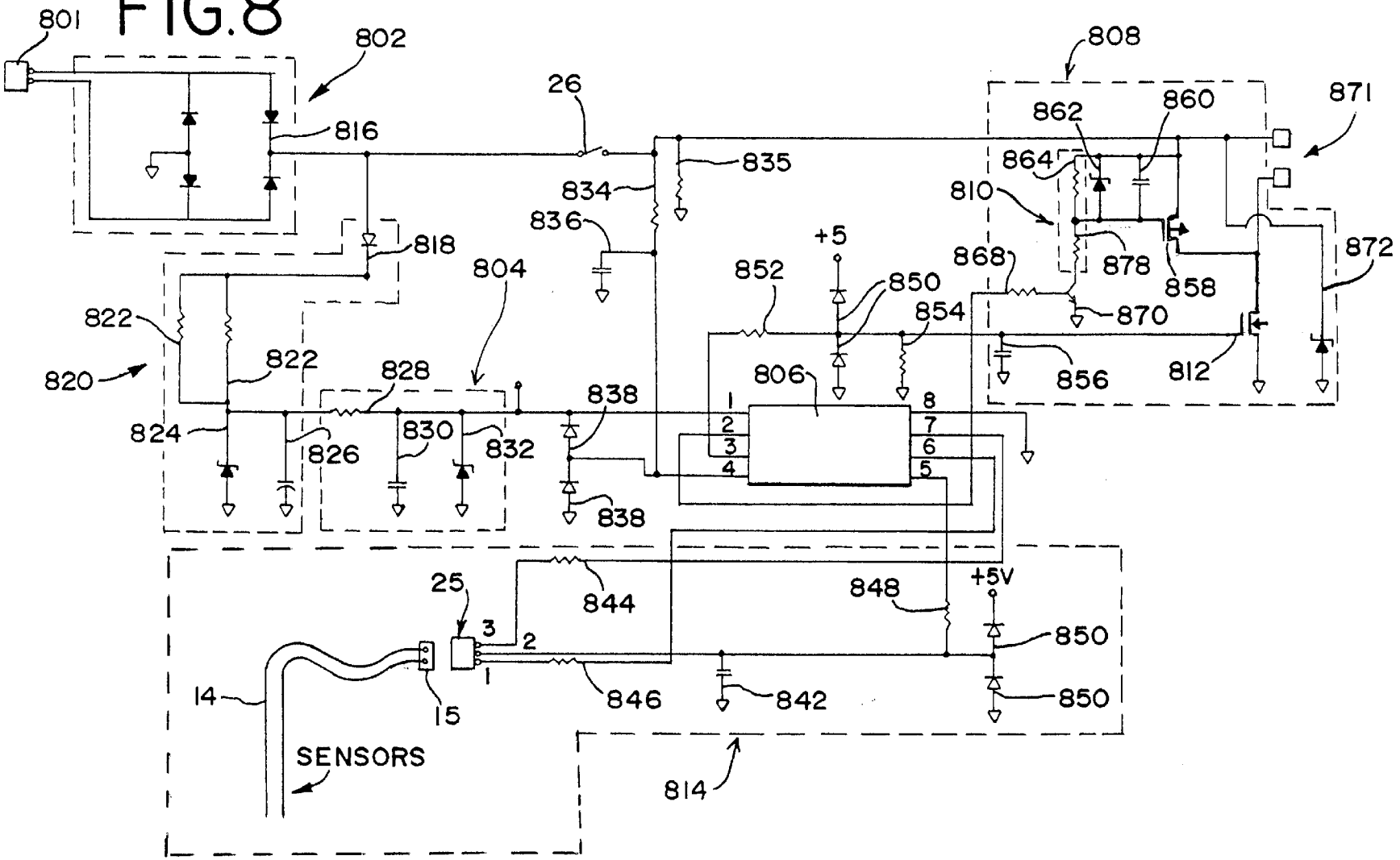
FIG. 8 is a schematic drawing of the electrical circuit used in the valve of FIG. 1B.

FIG. 8 depicts a circuit for a dispensing valve that will deliver PWM power to a solenoid. The solenoid itself is not shown on the circuit, but is connected by connector 871. This embodiment uses a 24-V solenoid, and thus 24V AC power is delivered from a transformer (not shown) via connector 801. Many of the components in FIG. 8 (but not the sensors 14) will be on a circuit board 24 (see FIG. 2), and will preferably be surface-mounted to reduce the cost and space required for the board. In general terms, the circuit includes a 24V DC power converter 802, and a 5V power supply 804 for a microprocessor controller 806. There is also a PWM circuit 808, a level shifter 810, a switch 812 (preferably in the form of a transistor or a FET) and a detection circuit 814. Each of these will be described below in more detail.

Power supply 802 (shown within dotted lines) may consist of a full-wave bridge rectifier 816 having four diodes, and converting 24V AC power to 24 V DC power. This DC power may have wide current or voltage swings in the circuit as depicted, because there is no capacitor. Of course, a capacitor may be added, but that will also add a good deal of additional mass and volume to the dispenser. Power is taken from the 24 V DC circuit 802 and converted to 12 V by power supply 820, and to 5 V by power supply 804. Power supply 804 (shown within dotted lines) includes resistor 828, capacitor 830 and 4.7 V Zener diode 832. Power supply 820 (also shown in dotted lines) includes diode 818 in series with resistors 822, 12V Zener diode 824, and capacitor 826. Resistors 822 may be the same or may be different. Capacitor 826 filters and stabilizes the output of the Zener at about 12V. Voltage divider 828 and filter capacitor 830, along with 4.7 V Zener diode 832, stabilize a voltage supply of about 5 V. The 5V output may be used as a power supply for microprocessor 806 on pin 1 of the microprocessor.

Other inputs to microprocessor 806 may include input pin 4, a voltage from the 24V DC power supply indicating that the microswitch 26 attached to actuating lever 14 has been closed. A protective circuit including resistors 834, 835, capacitor 836, and clamping diodes 838 protects the input to the microprocessor from excess voltage. Other inputs/outputs of the microprocessor 806 include pin 2, power to the PWM circuit 808 (shown in dotted lines) and level shifter 810 (also shown in dotted lines); pin 3 to switch 812, and pins 5, 6, and 7 to the detection circuit 814 (shown in dotted lines), which includes a resistance/continuity circuit. Microprocessor pins 5, 6, and 7 may terminate in connector 25 for connection to the connector 15 on the actuating lever. Microprocessor 806 may also have a ground connection via pin 8. It will be understood that the microprocessor may have other inputs and outputs.

As discussed above, actuating lever 14 has two conductors 72 and a connector 15 for connecting to the circuit board via connector 25. Connector 25 may have three pins, allowing the lever to be connected according to whether a "top-off" cycle is desired or not desired. Connector 15 may be connected via connector 25 to inputs 5 and 7 of the microprocessor 806 if a top-off cycle is desired, and may be connected to inputs 5 and 6 if a top-off cycle is not desired. Pin 5 is common to both. If a top-off cycle is desired, and connector 15 is connected via connector 25 to pins 5 and 7, the microprocessor will not detect any change in the detection circuit through pin 6, since pin 6 is not connected. Therefore, the microprocessor functions by detecting a change between pins 5 and 7. In FIG. 8, capacitor 842 is charged through a 5V supply. Thus, pin 5 of the microprocessor and pin 2 of connector 15 will have a voltage. When beverage liquid or foam provides an electrical path between the conductors 72 of lever 14, such as to pin 3 of connector 25, then pin 7 of the microprocessor will see a voltage. When microprocessor 806 checks pin 7 and notes that it has gone from no voltage to about 5V, the detection circuit has performed its function. The microprocessor then "knows" both to shut the valve and that a top-off cycle may be desired. Other circuitry for the resistance/continuity circuit 814 may include resistors 844, 846, 848, and diodes 850. Other circuits may be used to convert the continuity between conductors 72 into a current or a voltage, or even a different resistance to be detected by a detection circuit.

Once a user pushes a beverage cup against the lever 14, the microswitch 26 is closed, and 24 VDC power is available through connector 871 to the beverage solenoid valve. The circuit is completed when FET switch 812 also closes, completing the DC circuit to ground. The gate of FET switch 812 receives its signal from microprocessor pin 3. Microprocessor 806 may be protected from overvoltages via diodes 850, resistors 852, 854, and capacitor 856. The microprocessor 806 may be programmed for an initial period of time to apply full power to the solenoid, such as 0.5 to 2 seconds, preferably about 1 second. Afterwards, pulse-width-modulation is applied to the circuit from pin 2 of the microprocessor 806 though level shifter 810 and PWM circuit 808, and from pin 3 of the microprocessor to FET switch 812. In this embodiment, transistor 870 is an npn transistor, FET 812 is n-channel and FET 858 is p-channel. The outputs of pin 2 and pin 3 are opposite: when pin 2 is high, pin 3 is low and vice-versa.

FET 858 connects to 24 V DC through its source and to the return of the solenoid via its drain. The gate of FET 858 connects through a voltage divider comprising resistors 864, 878 to the source of transistor 870. Zener 872 protects FETs 812 and 858 from discharges and voltages from the solenoid. Resistor 868 protects input pin 2 of the microprocessor. On startup, pin 2 goes low and pin 3 goes high, turning off transistor 870 and turning on FET 812. FET 858 is thus also turned off while FET 812 is closed (on), giving solenoid coil current a path to ground.

During the off portion of the PWM cycle, pin 2 goes high, turning on transistor 870 and also FET 858. Pin 3 goes low, opening FET 812 (turning FET switch 812 off) and removing any path to ground. When transistor 870 is on, FET 858 turns on, current flows in resistors 864, 866, and the gate of FET 858 is pulled high, essentially shorting the ends of the solenoid coil. However, since FET 812 is open, there is no path to ground, so solenoid current does not flow.

The PWM circuit includes a level shifter 810, which is essentially resistors 864 and 878 in series, forming a voltage divider between the 24 VDC supply and transistor 870. Capacitor 860 and Zener diode 862 limit the range of voltages that can be applied to the gate of transistor 858. The transistors or FETs depicted in FIG. 8 may be electrical or electronic switches other than transistors or FETs. In particular, FETs 812 and 858 should be power devices, and may also include, but are not limited to, transistors, power transistors, MOSFETs, thyristors, insulated-gate bipolar transistors (IGBTs), silicon-controlled rectifiers (SCRs), MOS-controlled thyristors, and triacs. PWM transistor 870 does not necessarily need to pass power, as does FET 812, and thus transistor 870 may be provided with less current-carrying capacity.

Figure 9:
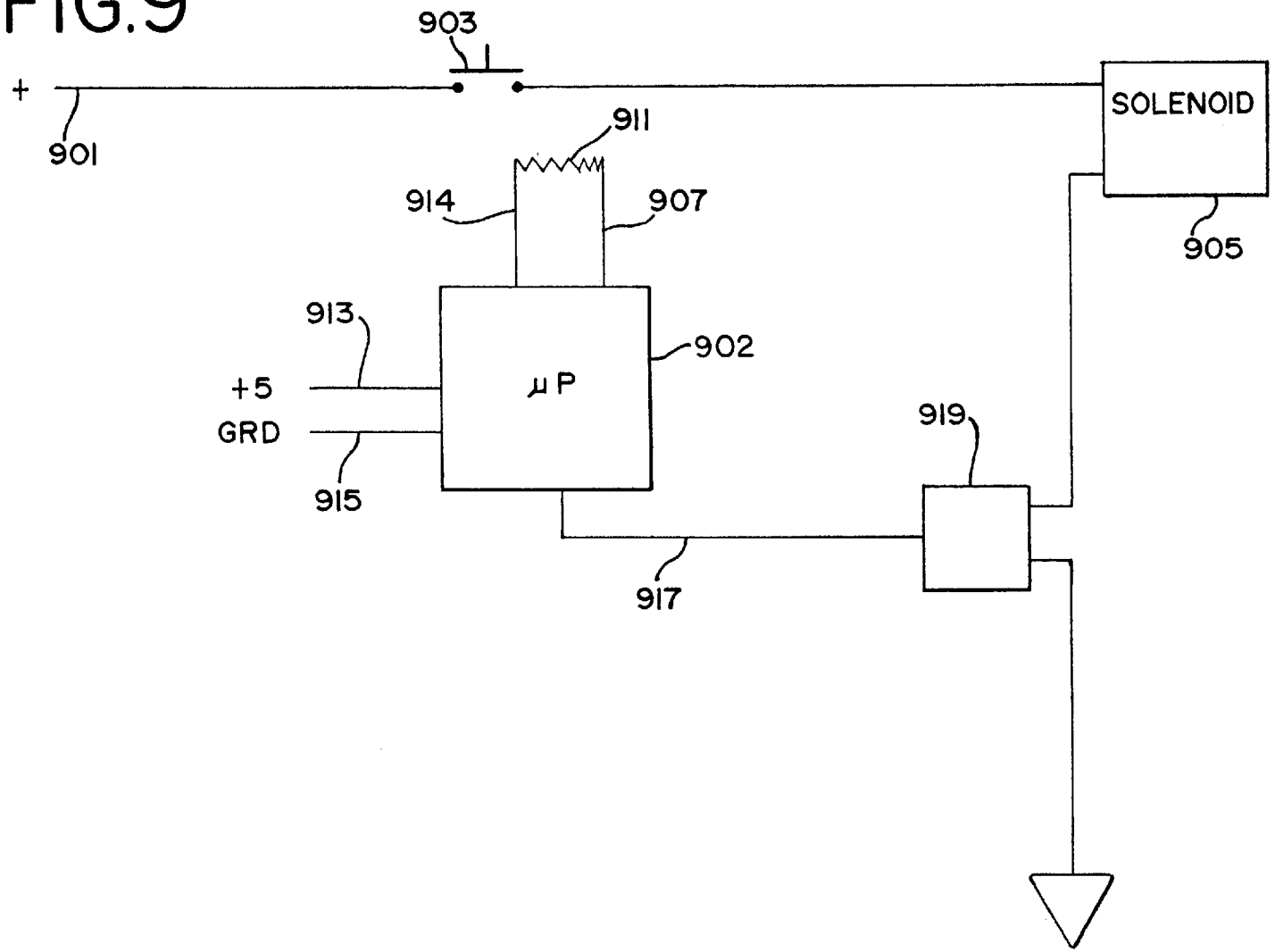
FIG. 9 is a schematic drawing of an alternate circuit that can be used in the valve of FIG. 1B.

FIG. 9 depicts a simplified circuit for providing PWM current to the solenoid. A power supply 901 connects to the solenoid 905 via momentary touch switch 903. Switch 903 may be a touch switch from a touch-screen or a push button mounted on the outside of a beverage dispenser. Microprocessor 902 measures resistance 911 through inputs 907, 914 once the cycle has begun. Microprocessor 902 is powered by power supply 913 and is connected to ground 915. PWM control is supplied to transistor 919 through an output 917 from the microprocessor to the gate of the transistor 919. When power to the solenoid is desired, transistor 919 is closed, allowing completion of the solenoid circuit to ground. During the off portion of the PWM cycles, transistor 919 is open, and no current flows in the solenoid.

Those skilled in the art will recognize that there are many ways to practice the invention. The external circuit has been described as a detection circuit, because a conductive beverage liquid or foam will conduct electricity and may dramatically change the resistance, voltage or current between the two metallic portions 72 of lever 14. As shown in FIG. 8, however, the circuit may be transformed by the addition of a capacitor and a power supply into a circuit where either voltage is applied or is not applied to a terminal of a microprocessor. The detection circuit is a "conductivity" circuit, in the sense that conduction between the spaced conductors is involved. The net effect of beverage liquid or foam is to change the circuit conductivity or resistance and allow a charge or a voltage to appear where it did not appear before. The circuit may also be configured as a circuit to detect current changes or measure voltage changes, which current or voltage changes depend on the resistive path of the beverage foam or liquid. As used in the claims, a "detection circuit" is meant to encompass all such circuits.

The preferred embodiment of the invention uses a lever having conductors, the conductors forming a part of the detection circuit and the lever also used to depress a microswitch to activate the beverage dispenser. This dual use is not required. For instance, in one embodiment a manufacturer may design in a touch-screen with cup-size selection options by which a user starts to dispense a beverage. These cup-size options may also be used to time an initial on-time for the solenoid of the beverage dispenser. Standard push-buttons on the beverage dispenser for each given cup size may also be used. In either case, pushing the touch-screen or push-button starts a fill cycle for a beverage and activates the detection circuit for the beverage foam or liquid to end the fill cycle and begin a "top-off" cycle.

A microprocessor controller is an excellent tool for applying PWM to a circuit. However, there are other ways of applying a PWM technique. A timing circuit that uses nothing more than a timer and an RC circuit with the appropriate time constant can deliver a repetitive voltage with set "on" and "off" periods. Using such a circuit and relays or reed switches can even enable a user to include a longer initial "on" period when first opening the solenoid valve. While an electrical circuit has been described to measure overflow of beverage liquid or foam, other methods may be used to determine when a container is full. These methods include infrared detectors, ultrasonic detectors, and volumetric detectors, such as detectors that integrate flow and deduce a volume. Detectors that sit under the container and measure its mass or weight may be used, as may timers. There are many other ways to practice this aspect of the invention.

Accordingly, it is the intention of the applicants to protect all variations and modifications of the present invention. It is intended that the invention be defined by the following claims, including all equivalents. While the invention has been described with reference to particular embodiments, those of skill in the art will recognize modifications of structure, materials, procedure and the like that will fall within the scope of the invention and the following claims.

What is claimed is:

1. An automatic shut-off valve for dispensing a beverage into a container, the automatic shut-off valve comprising:

a) at least one electrically-operated valve;

b) a detection circuit comprising at least two spaced conductors, the detection circuit wholly external to the container and capable of detecting conductivity between the at least two spaced conductors; and c) a controller that shuts off the at least one electrically-operated valve automatically when liquid or foam from a beverage creates a conductive path between the at least two spaced conductors.

2. The automatic shut-off valve according to claim 1 wherein the electrically-operated valve is a solenoid valve.

3. The automatic shut-off valve according to claim 2 wherein the solenoid is operated using a pulse-width-modulation technique.

4. The automatic shut-off valve according to claim 3 further comprising at least one power switch electrically connected to the solenoid, wherein applying the pulse-width-modulation technique by means of the power switch holds the solenoid open or closed.

5. The automatic shut-off valve according to claim 4 wherein the power switch is selected from the group consisting of a transistor, a FET, a MOSFET, a thyristor, an IGBT, a silicon-controlled rectifier, an MOS-controlled thyristor, and a triac.

6. The automatic shut-off valve according to claim 1 wherein the at least two conductors comprise stainless steel.

7. The automatic shut-off valve according to claim 1 wherein the at least two conductors are spaced apart by thermoplastic material.

8. The automatic shut-off valve according to claim 7 wherein the thermoplastic material comprises a blend of polycarbonate and PET polyester.

9. The automatic shut-off valve according to claim 1 further comprising a a microswitch, wherein the two spaced conductors are located on the lever and the lever can activate the microswitch which in turn controls power to the controller.

10. The automatic shut-off valve according to claim 1 wherein the controller is a microprocessor controller.

11. The automatic shut-off valve according to claim 1 wherein the two spaced conductors are separated by a peaked surface.

12. An automatic shut-off valve for dispensing a beverage into a container, the automatic shut-off valve comprising:

a) a detection circuit comprising at least two spaced conductors, the detection circuit wholly external to the container; and b) a controller controlling at least one power switching circuit, and connected to at least one electrically-operated solenoid valve, wherein a user may dispense a beverage by activating the power switching circuit to open the at least one electrically-operated solenoid valve, and the controller automatically shuts the at least one electrically-operated solenoid valve upon detecting a change in the detection circuit.

13. The automatic shut-off valve according to claim 12 further comprising a lever connected to a microswitch for activating the switching circuit.

14. The automatic shut-off valve according to claim 13 wherein the two spaced conductors are on a surface of the lever.

15. The automatic shut-off valve according to claim 12 wherein the at least two spaced conductors are mounted on an insulative portion, the conductors forming sensors for the detection circuit, and wherein controller automatically shuts off the at least one electrically-operated solenoid valve when the at least two conductors of the lever are in contact with beverage foam or liquid.

16. The automatic shut-off valve according to claim 12 wherein the power switching circuit is a pulse-width-modulation circuit.

17. The automatic shut-off valve according to claim 12 wherein the power switching circuit comprises at least one power switch.

18. The automatic shut-off valve according to claim 17 wherein the at least one power switch is selected from the group consisting of a transistor, a FET, a MOSFET, a thyristor, an IGBT, a silicon-controlled rectifier, an MOS-controlled thyristor, and a triac.

19. The automatic shut-off valve according to claim 12 wherein the at least two conductors are mounted on a lever, the lever having a peaked surface allowing beverage foam or liquid to condense and to dissipate.

20. The automatic valve according to claim 12 wherein the at least two conductors are stainless steel conductors spaced apart by thermoplastic material.

21. The automatic shut-off valve according to claim 20 wherein the thermoplastic material comprises a blend of polycarbonate and PET polyester.

22. A method of dispensing a beverage with an automatic shut-off valve, the method comprising:

a) providing a container having an open mouth;

b) opening at least one electrically-operated valve to begin dispensing the beverage into the container;

c) detecting a change in an electrical detection circuit wholly external to the container while dispensing the beverage; and d) automatically closing the electrically-operated valve upon detecting a change in the electrical detection circuit.

23. The method of claim 22 further comprising keeping the electrically-operated valve open by a pulse-width-modulation technique while dispensing the beverage.

24. The method of claim 22 wherein opening the at least one valve is accomplished by pressing a lever, touching a screen, or pushing a button.

25. The method of claim 22 wherein detecting the change in the detection circuit and automatically closing the valve is accomplished via a controller.

26. The method of claim 22 wherein the detection circuit detects conductivity between spaced conductors to close the electrically-operated valve.

27. The method of claim 26 further comprising e) waiting a period of time after automatically closing the electrically-operated valve and automatically checking whether the detection circuit is in a non-conducting state, and if so, initiating a top-off routine.

28. The method of claim 27 wherein the top-off routine comprises:

i) opening the at least one electrically-operated valve to begin dispensing the beverage into the container;

ii) detecting a subsequent change in the electrical detection circuit; and iii) automatically closing the at least one electrically-operated valve upon detecting said subsequent change in the electrical detection circuit.

29. The method of claim 22 wherein the change in the detection circuit is caused by beverage liquid or foam contacting, or dissipating from, at least two conductors molded into a lever.

30. A method of dispensing a beverage into a container, the method comprising:

a) providing a container;

b) opening at least one solenoid valve to fill the container with the beverage;

c) keeping the valve open by a pulse-width-modulation technique while operating a detection circuit wholly external to the container; and d) closing the valve automatically upon detecting a change in the detection circuit.

31. The method of claim 30 wherein the change in the detection circuit is a change in conductivity.

32. The method of claim 31 further comprising:

e) automatically rechecking the detection circuit to see if the detection circuit has gone to a non-conducting state and if so, initiating a top-off routine, wherein the top-off routine comprises i) re-opening the at least one solenoid valve to top-off the container; and ii) reclosing the valve automatically upon detecting a subsequent change in the detection circuit.

33. The method of claim 31 wherein the change in the detection circuit is caused by beverage foam or liquid contacting and thus forming a conductive path between sensors in the detection circuit, and thereafter dissipating so as to break the conductive path.

34. A method of dispensing a beverage, the method comprising:

a) providing a beverage dispenser having at least one solenoid-operated valve;

b) opening the at least one solenoid-operated valve to begin dispensing a beverage;

c) using a pulse-width-modulation technique to hold the solenoid-operated valve open during a filling operation; and d) closing the at least one solenoid-operated valve upon a change in conductivity in a detection circuit comprising at least two spaced conductors, the detection circuit wholly external to a container for receiving the beverage.

35. The method of claim 34 wherein the valve is closed automatically by a technique selected from the group consisting of electrical detection and timing, wherein the timing technique is a back-up to the electrical detection technique.

36. The method of claim 34 further comprising:

e) automatically rechecking the detection circuit to see if the detection circuit has gone to a non-conducting state and if so, initiating a top-off routine, the top-off routine including:

i) re-opening the at least one solenoid valve to top-off the container; and ii) reclosing the valve automatically.

37. The method of claim 36 wherein the valve automatically closes upon receiving a signal from a technique selected from the group consisting of electrical detection, infrared detection, ultrasonic detection, volumetric detection, weight detection, and timing.

38. The method of claim 36 wherein the step of re-opening occurs automatically after the detection circuit has gone to a non-conducting state and after a wait period of at least 0.25 seconds.

39. The method of claim 34 wherein the valve is opened by a technique selected from the group consisting of pressing a button, touching a screen, and pushing on a lever.

40. The method of claim 34 wherein the beverage is a soft drink.

41. The method of claim 34 wherein the change in conductivity in the detection circuit is caused by beverage foam or liquid contacting, or dissipating from, at least two conductors molded in a lever.

42. A beverage dispenser for dispensing a beverage into a container, the beverage dispenser comprising:

a) at least one mixing and dispensing valve for dispensing a beverage, the at least one mixing and dispensing valve comprising:

i) at least one solenoid-operated valve for controlling a flow of at least one fluid;

ii) a detection circuit comprising at least two spaced conductors, the detection circuit wholly external to the container and capable of detecting conductivity between the at least two spaced conductors; and iii) a controller that shuts off the at least one solenoid-operated valve automatically when beverage foam or liquid creates a conductive path between the at least two spaced conductors;

b) a drip tray below the at least one mixing and dispensing valve; and c) a housing for mounting the drip tray and the at least one mixing and dispensing valve.

43. The beverage dispenser of claim 42 wherein the at least two spaced conductors comprise stainless steel.

44. The beverage dispenser of claim 42 wherein the controller is in communication with the detection circuit, and the controller is programmed to open the at least one solenoid valve to fill a container with the beverage, and programmed to shut off the solenoid valve automatically when the conductive path is created.

45. The beverage dispenser of claim 42 wherein the controller is a microprocessor controller.

46. The beverage dispenser of claim 42 wherein the controller opens the at least one solenoid-operated valve based on an input received from the group consisting of a push-button, a touch-screen, and a lever.

47. The beverage dispenser of claim 46 further comprising a microswitch electrically connected to the controller and wherein the lever comprises the two spaced conductors and an insulative material having a crowned surface.

48. The beverage dispenser of claim 42 wherein the detection circuit is selected from the group consisting of an electrical detection circuit and a timer, wherein the timer is a back-up to the electrical detection circuit.

49. The beverage dispenser of claim 42 further comprising at least one power switch electrically connected to the at least one solenoid valve, wherein the controller keeps the at least one solenoid-operated valve open by a pulse-width-modulation technique while dispensing the beverage.

50. The beverage dispenser of claim 48 wherein the power switch is selected from the group consisting of a transistor, a FET, a MOSFET, a thyristor, an IGBT, a silicon-controlled rectifier, an MOS-controlled thyristor, and a triac.

51. The beverage dispenser of claim 42 further comprising a microswitch electrically connected to the controller.

52. The beverage dispenser of claim 42 wherein the at least two spaced conductors are separated by an insulative material having a peaked surface.

53. The beverage dispenser of clam 42 further comprising two fluid paths controlled by the at least one solenoid valve, a mixing chamber downstream from the two fluid paths, and a nozzle downstream of the mixing chamber.

* * * * *